US007550188B2

(12) United States Patent
Lesson

(10) Patent No.: US 7,550,188 B2
(45) Date of Patent: Jun. 23, 2009

(54) SLOTTED STILE SYSTEM

(75) Inventor: Timothy Lesson, Stillwater, NY (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 437 days.

(21) Appl. No.: 11/027,621

(22) Filed: Dec. 29, 2004

(65) Prior Publication Data

US 2006/0174576 A1 Aug. 10, 2006

(51) Int. Cl.
*B32B 3/10* (2006.01)

(52) U.S. Cl. ..... 428/60; 52/586.1; 52/239

(58) Field of Classification Search ..... 428/60, 428/58, 59; 52/586.1, 34, 457, 582.1, 239, 52/241

See application file for complete search history.

(56) References Cited

U.S. PATENT DOCUMENTS 2,332,081 A 10/1943 Hunt et al.
2,401,281 A 5/1946 Webb
2,831,223 A 4/1958 De Shazor, Jr.
3,374,703 A 3/1968 Davis et al.
5,694,730 A 12/1997 Del Rincon et al.
2003/0003258 A1 1/2003 Durso et al.
2003/0046892 A1 3/2003 Albany et al.

*Primary Examiner*—Alexander Thomas
(74) *Attorney, Agent, or Firm*—Christie, Parker & Hale, LLP.

(57) ABSTRACT

A stile for at least partially enclosing a toilet, the stile includes a first board with a first face and a first edge surface adjacent to the first face, at least a part of the first edge surface defining a first slot. A second board with a second face and a second edge surface is adjacent to the first face, and at least a part of the second edge surface defines a second slot. The second edge surface is proximate to the first edge surface and the first face is adjacent to the second face with a joining line therebetween. An insert sheet is disposed within both the first slot and the second slot and adheres within the slots with adhesive. A laminate is fixed to and covers the first face, the second face, and he joining line.

10 Claims, 8 Drawing Sheets

SLOTTED STILE SYSTEM

BACKGROUND

Some standard toilet stiles use steel cores and are typically manufactured by gluing one sheet of particle board onto each side of a sheet of steel. The sheet of steel typically has a shorter length and width than the particle board sheets, so a filler of wood or filler, such as Masonite™, is typically used to fill the gaps between the particle board sheets. After the gaps are sufficiently filled, a laminate is glued along the entire periphery of the stile to cover the exposed edges of the particle board and wood or filler. This three-layer design allows the stile to have sufficient strength to withstand the daily wear and tear that is common for a toilet stile, particularly in a public toilet.

The process of creating this three-layer toilet stile design involves first cutting relatively thin, for example, ⅜" thick, and wide sheets of particle board, which usually requires the cooperation of at least two workers. Then, wood or filler, such as Masonite (R), is cut into pieces sufficient to fill gaps along both sides and the top edge of the steel sheet.

Glue is then placed between the steel sheet, particle board sheets, and the wood or filler and the components are cold pressed together for a period of around 45-60 minutes. Because of the number of components and the large size of the surfaces that must be glued together, this step requires the storage and use of large amounts of glue. Moreover, special machines designed for batch gluing of these surfaces are expensive and generate large amounts of glue waste during every cleanup. The stile is then trimmed to a desired width with an industrial saw and the stiles can be stored until the particular width is needed to fill an order.

A plastic laminate is then hot pressed along the entire periphery of the stile to cover the exposed junctions between the wood or filler and the particle boards.

This process can be time consuming, labor intensive, expensive, and can require a wide assortment of materials to be stored and used. Because many materials must be stored and many steps require a large amount of floor space, setup, and cleanup, environmental and safety concerns may be raised. A need exists, therefore, for a slotted stile system and manufacturing method requiring fewer materials and work space, easier handling, less expensive machinery, and less waste, while maintaining the strength necessary to withstand the normal wear and tear of a toilet stile.

SUMMARY

One or more of these needs may be met by various embodiments of the slotted stile system and method according to the current invention. A toilet stile is disclosed that has a first board with a first face and a first edge surface adjacent to the first face. At least a part of the first edge surface defines a first slot. A second board is provided that has a second face and a second edge surface adjacent to the first face. At least a part of the second edge surface defines a second slot. The second edge surface is proximate to the first edge surface and the first face is adjacent to the second face with a joining line therebetween. An insert sheet is disposed within both the first slot and the second slot. An adhesive is disposed within the first slot and the second slot and adheres the insert sheet therebetween. A laminate is fixed to and covers the first face, the second face, and the joining line.

DETAILED DESCRIPTION OF THE PREFERRED EMBODIMENTS

Figure 1:
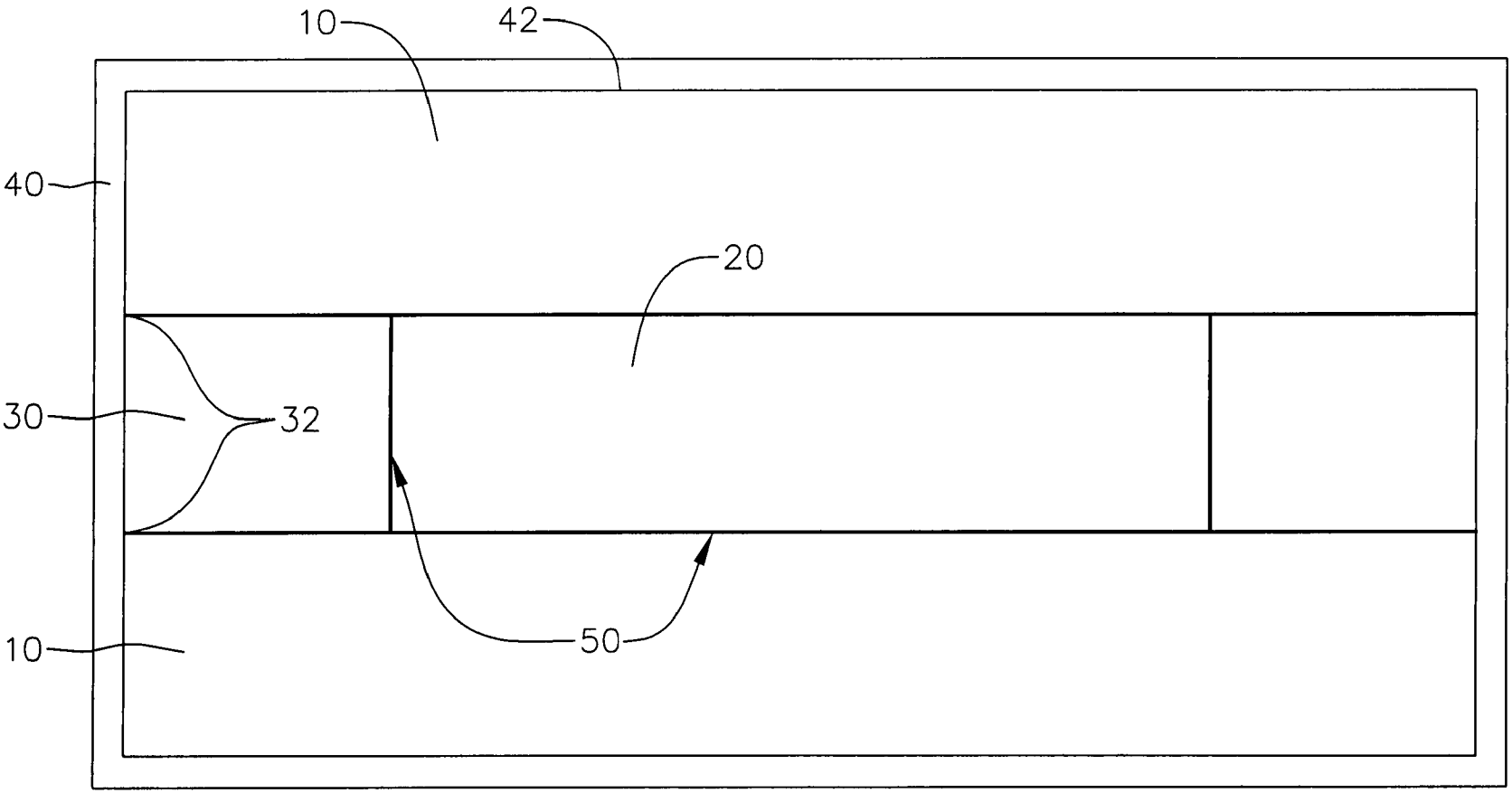
FIG. 1 PRIOR ART
FIG. 1 is a top cross-sectional view of a prior art toilet stile.
Figure 2:
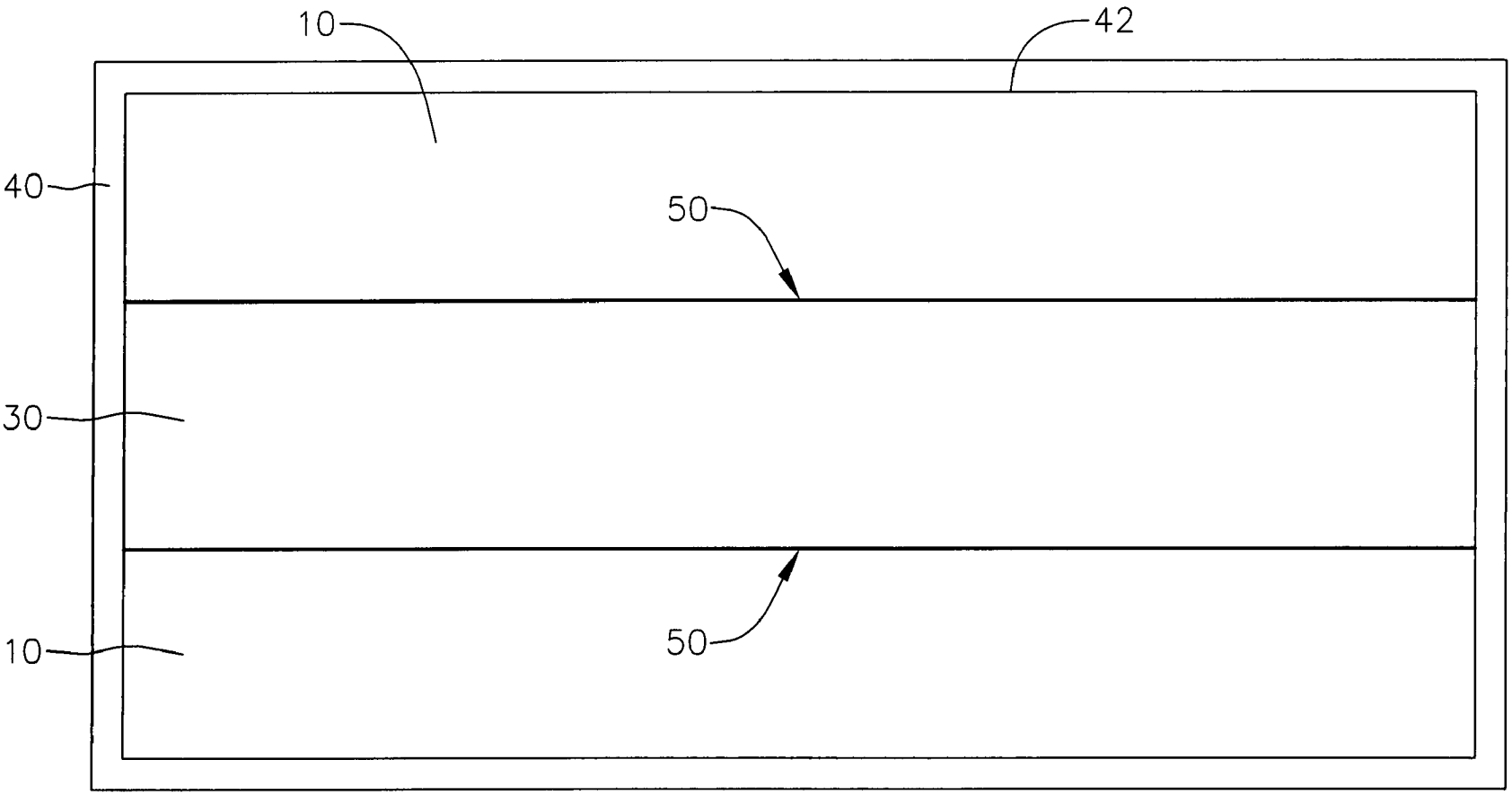
FIG. 2 PRIOR ART
FIG. 2 is a top view of the prior art toilet stile of FIG. 1 without the top laminate.
Figure 3:
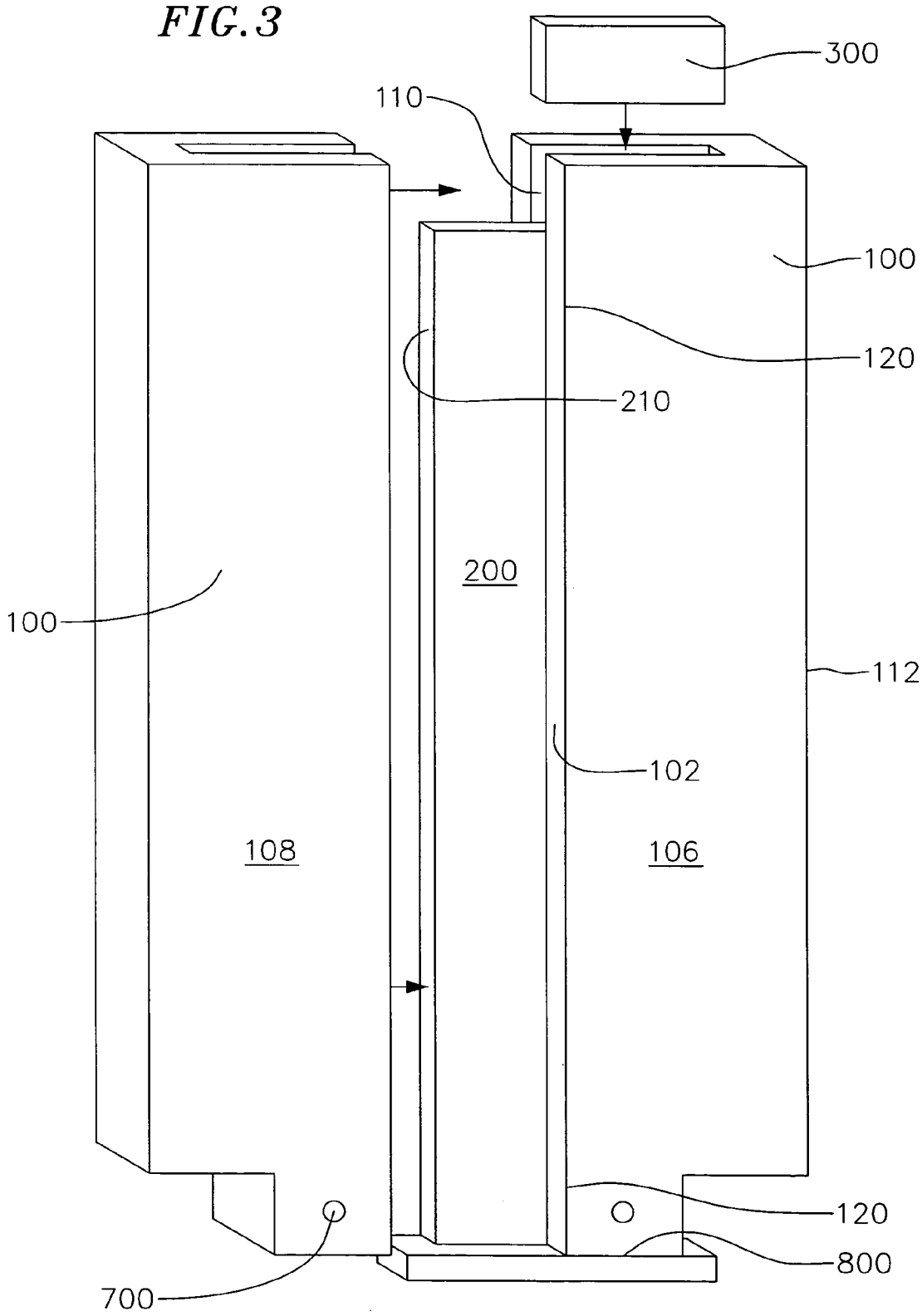
FIG. 3 is a side exploded view of an unlaminated toilet stile according to one embodiment of the invention.

A prior art toilet stall is shown in FIGS. 1 and 2. As described above, two boards 10 made of wood, such as particle board, are placed on both sides of an insert sheet 20 composed of steel. The boards 10 have a width that varies from 3-24 inches and are approximately ⅜-inch thick. The insert sheet has a shorter width than the boards 10, and strips of filler 30, such as Masonite™, are placed on either side of the insert sheet 20 between the two boards 10. As shown in FIG. 2, a strip of filler 30 is also placed along the top of the insert sheet 20 between the two boards 10, as the insert sheet 20 is not coextensive with the top of the two boards 10.

Glue 50, or any suitable adhesive, is placed along the surfaces of the insert sheet 20, strips of filler 30, and the boards 10, and these elements are pressed in a cold press (not shown) to fix them together as a unit.

As described above, the units can then be used immediately or stored until requested by a customer. The units can then be trimmed according to the desired stile size. After trimming, laminate 40 is applied to the side periphery 42 and top (not shown) of the unit in an edge bander to seal and hide the junctions 32 between the strips of filler 30 and the boards 10.

FIGS. 3-6 show a first embodiment of a toilet stile according to the invention. A board 100 has a face 106 and a slot 110 milled longitudinally along one edge 102. In this embodiment, the board 100 is particle board with a thickness of approximately ⅞-inch, which is more than twice the thickness of the prior art board 10 in FIGS. 1 and 2. The board 100 also has a narrower width than those described above. The width, for example, may be between 1.5 and 16 inches, with approximately ⅜ or 1⅜ inches between the unslotted edge 112 of the board and the deepest point in the slot. Because the board's thick, narrow shape is more rigid than the thin, wide shape of the prior art board 10, it can be more easily handled by a single person.

A second, identical board 100, with a face 108 and a slot 110 running along its edge 104, is placed adjacent to the first board 100 to create a cavity from the two slots 110 in which an insert part 200 is placed. In this embodiment, the insert part 200 is ⅛" thick and composed of steel.

Glue 500 or other suitable adhesive is placed within the slots 110 of the boards 100 to fix the insert part 200 within the cavity. In this embodiment, gaps 220 exist between each longitudinally extending edge 210 of the insert part 200 and the innermost wall of each slot 110. Gaps 220 serve to capture excess glue 500 squeezed out from between the boards 100 and the insert part 200. It is also within the scope of the invention to not have the gaps 220 so that the insert part 200 and the slots 110 are substantially coextensive. In an alternate embodiment, glue 500 can also placed between the edges 102, 104 to fix them to each other along a joining line 120 (see FIG. 5).

Figure 6:
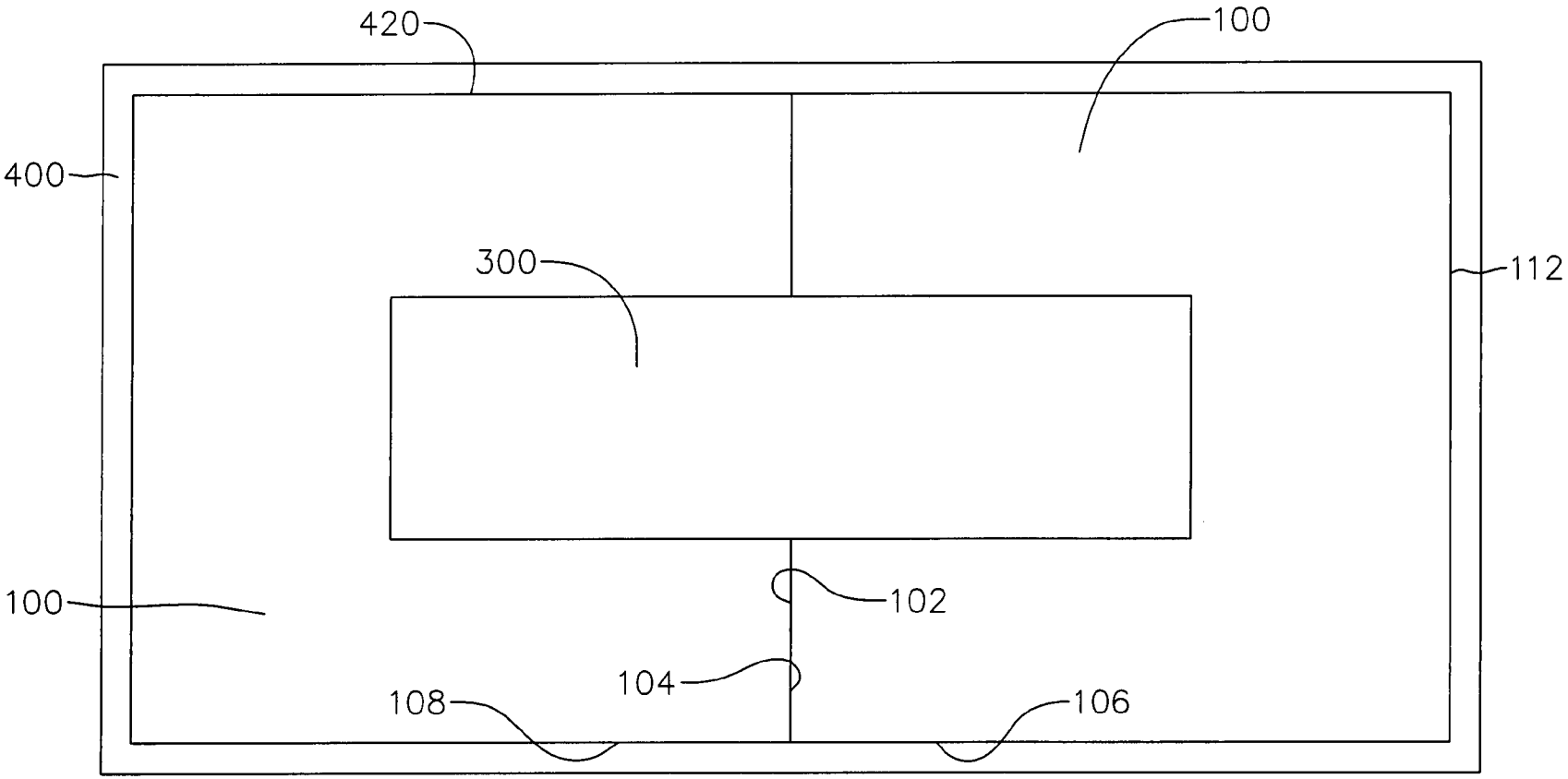
FIG. 6 is a top view of the embodiment shown in FIG. 3 without the top laminate.
Figure 7:
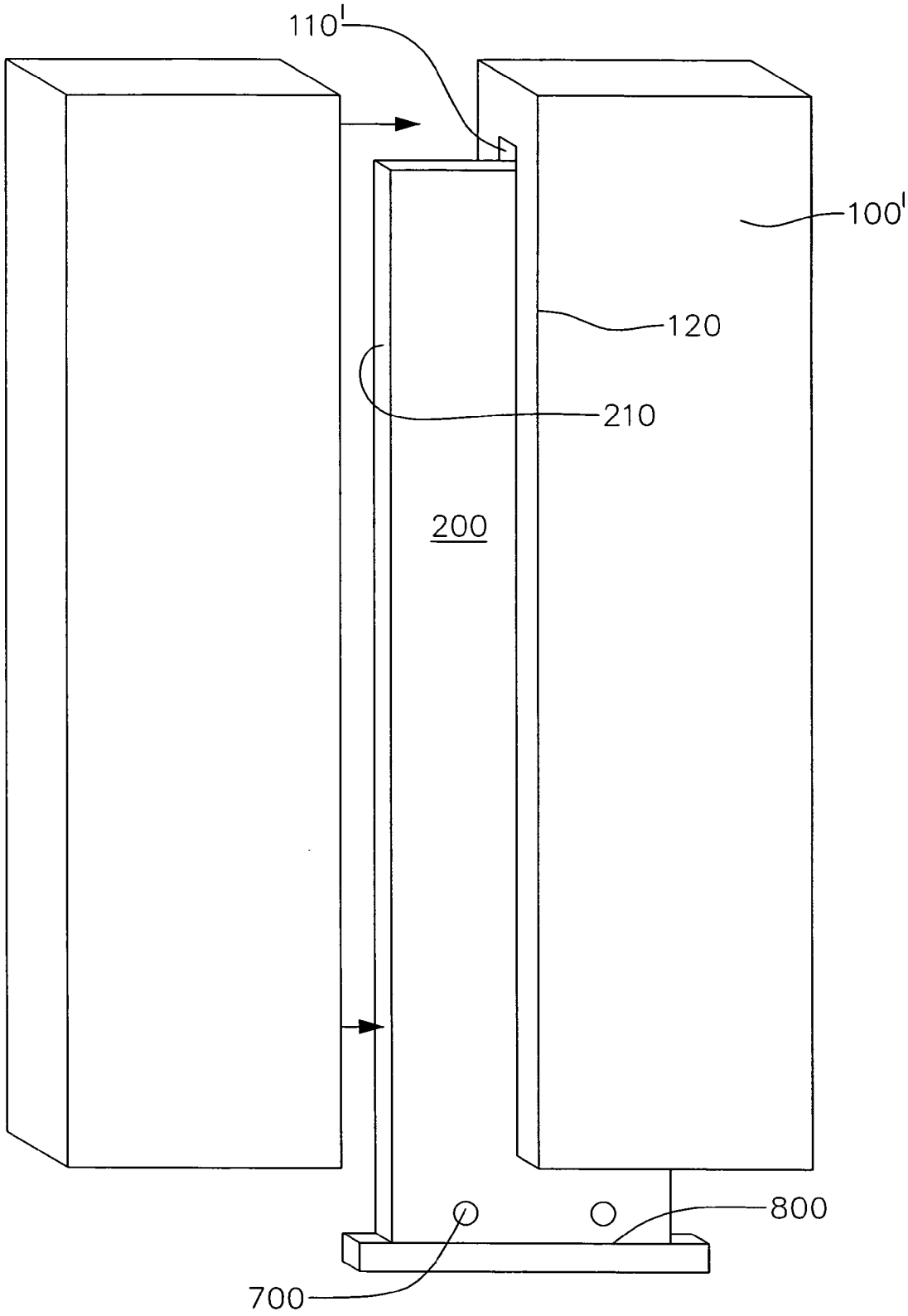
FIG. 7 is a side exploded view of an unlaminated toilet stile according to another embodiment of the invention.

As shown in FIG. 6, a ⅛" Masonite™ filler 300 is inserted above the insert part 200 within the cavity. As shown in FIG.

7, the slots 110' can alternatively end directly above the insert part 200 so that the cavity is closed above the insert part 200 by the boards 100' themselves.

The embodiments shown in FIGS. 3-7 include adhesive only within the slots 110, 110'. Therefore, substantially less glue 500 is required for fixing these elements together than in the prior art. Additionally, much less filler 300 is required for filling the gaps between the insert part 200 and the boards 100, 100', as the sides of the insert part 200 are covered by the boards 100'. Moreover, the cold press equipment and processing is unnecessary in this embodiment, as the boards 100' are formed as a unitary whole partially surrounding the insert part.

The boards 100, 100' cover both longitudinally extending edges 210 of the insert part 200, providing a better seal than the exposed, peripheral junctions 32 of the toilet stile shown in FIGS. 1-2.

An approximately 1/16 inch thick plastic laminate 400 is edge banded as to the side periphery 420 and top of the boards 100, over the joining line 120 of the boards 100. This laminate is used to further seal the junctions in the materials.

Figure 4:
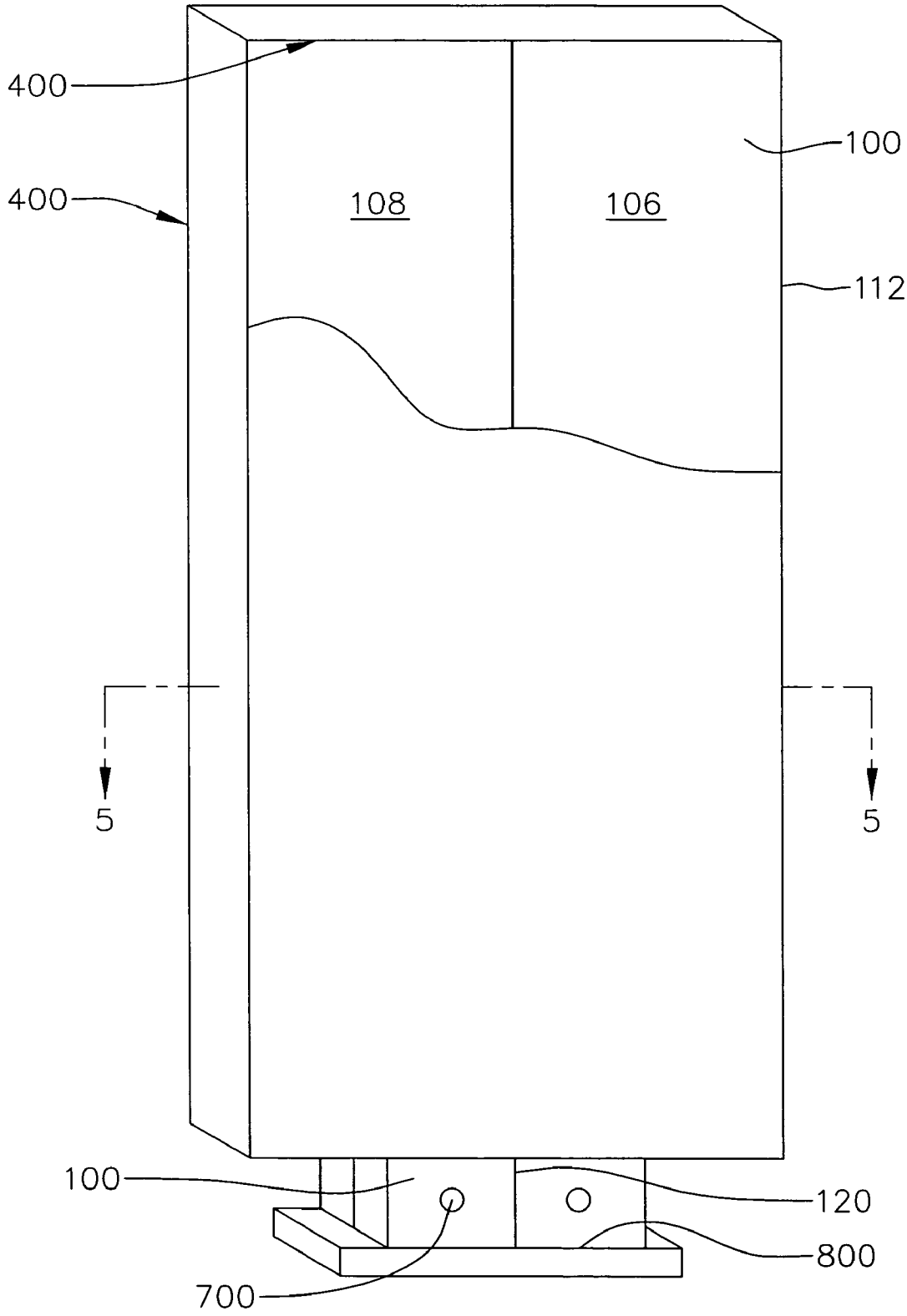
FIG. 4 is a side cutaway view of the embodiment shown in FIG. 3 with laminate included.
Figure 5:
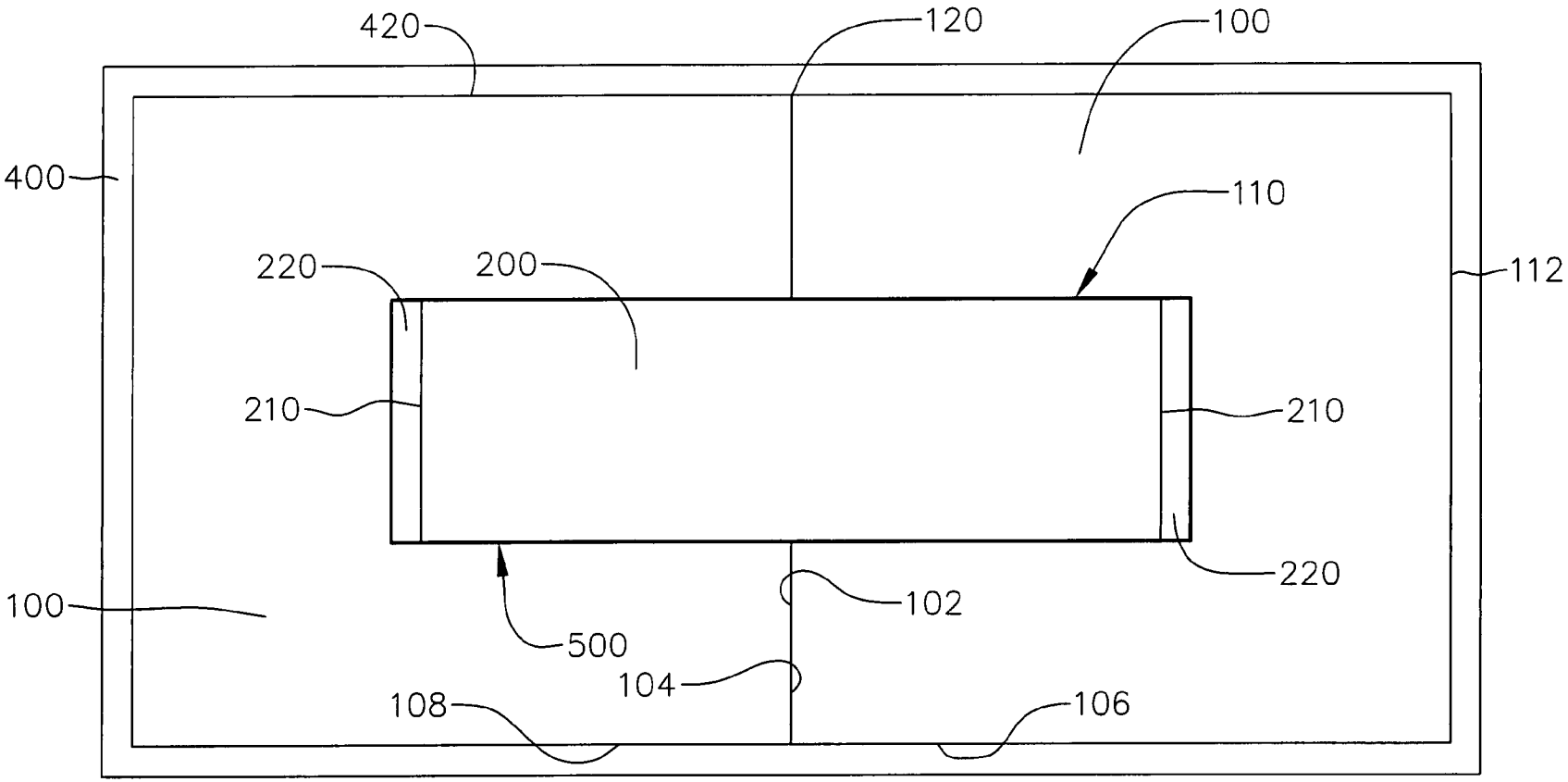
FIG. 5 is a top cross-sectional view along the line 5-5 of FIG. 4.

As shown in FIG. 4, the boards 100 and insert part 200 extend below the laminate 400. The insert part 200 is welded to a base 800. Screws can project through bores 700 in the boards 100 and the insert part 200 to more securely fix the insert part 200 and the boards 100 together.

Figure 8:
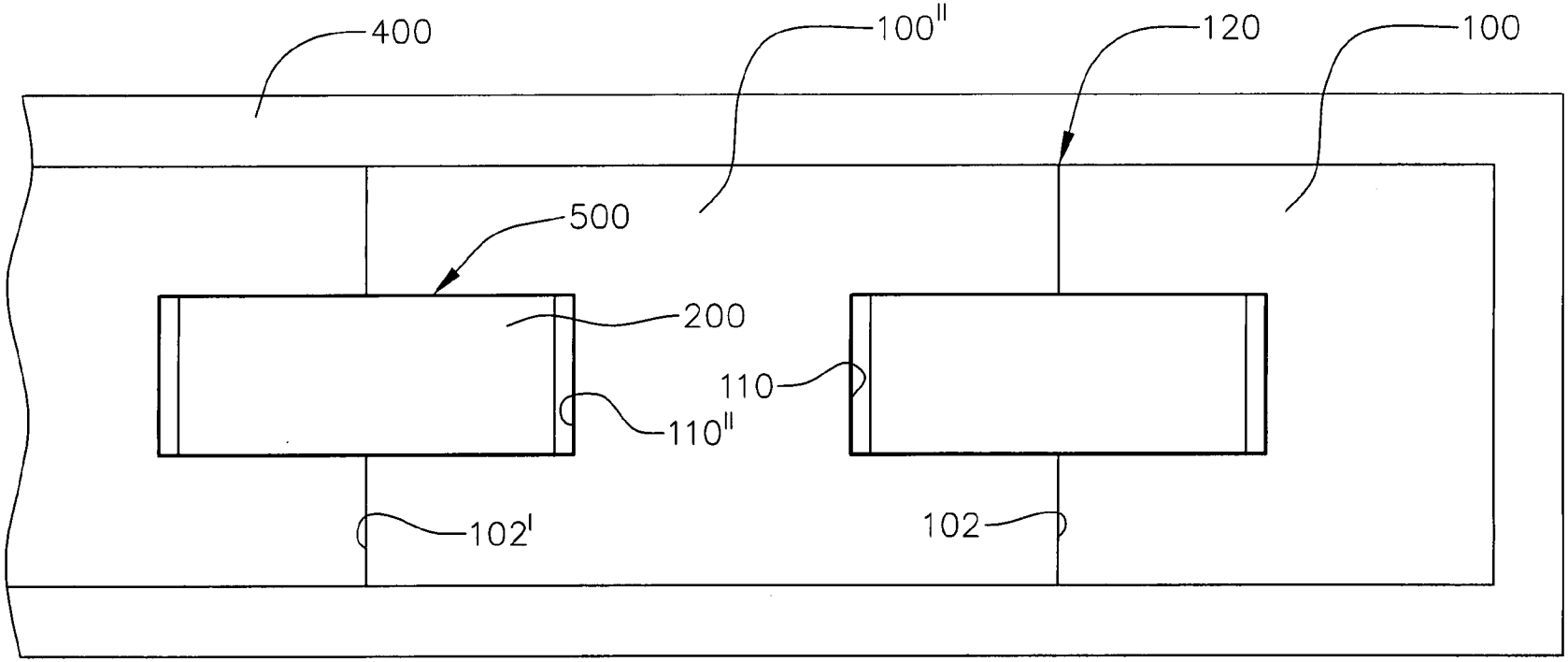
FIG. 8 is a top cross-sectional view of a second embodiment of a toilet stile according to the invention.

FIG. 8 shows another embodiment of a toilet stile according to the invention. Board 100" has two opposite slots 110, 110" along its edges 102, 102', in which two different insert parts 200 can be glued 500. A second board 100 faces the edge 102 of the board 100" and covers the insert part 200, as discussed above. A third board 100 faces the other edge 102' of the board 100" and covers the other insert part 200. In this embodiment, a toilet stile in any number of sizes can be manufactured without the need to trim the size or handle large surfaces using multiple personnel. Because this embodiment of the stile can be freely adapted to many different sizes, storage of multiple sizes of the stiles is eliminated, and backorders can be reduced.

Although specific embodiments are disclosed herein, it is expected that persons skilled in the art can and will design alternative toilet stile systems and methods of manufacture that are within the scope of the following claims either literally or through substantial equivalents. For example, although the above discussion has described the boards, insert part, and filler as respectively made of particle board, steel and Masonite™, with specific dimensions, it should be understood that any materials or dimensions suitable for providing sufficient strength and durability to withstand normal wear and tear may be substituted.

What is claimed is:

1. A stile for a toilet, the stile comprising:

a first board having a front large area surface, an opposed back large area surface, first and second opposed small area side surfaces extending between the front and back large area surfaces, and first and second opposed small area end surfaces extending between the front and back large area surfaces and between the first and second opposed small area side surfaces, at least a part of one of the first and second opposed small area side surfaces, at a location between the first and second opposed small area end surfaces, defining a first slot;

a second board having a front large area surface, an opposed back large area surface, first and second opposed small area side surfaces extending between the front and back large area surfaces, and first and second opposed small area end surfaces extending between the front and back large area surfaces and between the first and second opposed small area side surfaces, at least a part of one of the first and second opposed small area side surfaces, at a location between the first and second opposed small area end surfaces, defining a second slot, wherein the front surface of the first board is adjacent to and facing the same direction as the front surface of the second board with a joining line therebetween, the joining line extending in a longitudinal direction;

an insert sheet disposed within both the first slot and the second slot, the insert sheet comprising steel; and a laminate fixed to and covering the front surface of the first board and the front surface of the second board, and covering the joining line;

wherein the insert sheet has opposed first and second edges that extend transversely to the longitudinal direction, the first edge of the insert sheet adjacent the first small area end surfaces of the first and second boards and the second edge of the insert sheet adjacent the second small area end surfaces of the first and second boards; and wherein the first edge of the insert sheet is spaced from the first small area end surfaces in a direction of the second edge of the insert sheet along the longitudinal direction.

2. The stile according to claim 1, wherein the first board and the second board have a greater length along the longitudinal direction than does the insert sheet.

3. The stile according to claim 1, wherein the first slot and the second slot end between the first edge of the insert sheet and the first small area end surfaces of the first and second boards so that the first board and the second board substantially cover the first edge of the insert sheet.

4. The stile according to claim 1 further comprising a filler within the first slot and the second slot to substantially cover the first edge of the insert sheet.

5. The stile according to claim 1, further comprising:

a third board having a front large area surface, an opposed back large area surface, first and second opposed small area side surfaces extending between the front and back large area surfaces, and first and second opposed small area end surfaces extending between the front and back large area surfaces and between the first and second opposed small area side surfaces, at least a part of one of the first and second opposed small area side surfaces of the third board, at a location between the first and second opposed small area end surfaces, defining a third slot and at least a part of the other of the first and second opposed small area side surfaces of the third board defining a fourth slot; and a second insert sheet disposed within the third slot and the fourth slot, the second insert comprising steel.

6. The stile according to claim 1, further comprises a base, wherein the insert sheet is fixed to the base, and wherein the insert sheet has an end portion comprising the second edge, the end portion extending past the second small area end surfaces.

7. The stile according to claim 1, wherein a material between the first edge of the insert sheet and the first small area end surfaces of the first board and the second board covers the first edge of the insert sheet and wherein the material does not extend past the first small area end surfaces in the longitudinal direction.

8. The stile according to claim 7, wherein a further laminate is fixed to and covers the first small area end surfaces of the first and second boards to cover the material.

9. The stile according to claim 1 further comprising an adhesive fixing the first board to the second board.

10. The stile according to claim 9, wherein the adhesive is located in the first and second slots.

* * * * *